United States Patent [19]

Karabedian

[11] 4,069,934

[45] * Jan. 24, 1978

[54] CONTAINER WITH IMPROVED HEAT-SHRUNK CELLULAR SLEEVE

[75] Inventor: James A. Karabedian, Garden City, N.Y.

[73] Assignee: Owens-Illinois, Inc., Toledo, Ohio

[ * ] Notice: The portion of the term of this patent subsequent to Sept. 7, 1993, has been disclaimed.

[21] Appl. No.: 735,553

[22] Filed: Oct. 26, 1976

Related U.S. Application Data

[63] Continuation of Ser. No. 505,646, Sept. 13, 1974, abandoned.

[51] Int. Cl.[2] ..... B65D 1/02; B65D 11/16

[52] U.S. Cl. ..... 215/12 R; 215/DIG. 6; 428/35; 428/315; 428/321; 428/910; 428/913

[58] Field of Search ..... 428/35, 304, 310, 313, 428/315, 320, 517, 910, 913; 215/12 R, DIG. 6

[56] References Cited

U.S. PATENT DOCUMENTS

| | | | |
|---|---|---|---|
| 3,224,984 | 12/1965 | Roper et al. | 428/35 |
| 3,446,760 | 5/1969 | Nowak et al. | 428/35 |
| 3,531,367 | 9/1970 | Karsten | 428/315 |
| 3,632,252 | 1/1972 | Amberg et al. | 156/224 |
| 3,649,437 | 3/1972 | Wolinski et al. | 428/315 |
| 3,663,663 | 5/1972 | McAda | 428/35 |
| 3,725,191 | 4/1973 | Bloom | 428/315 |
| 3,760,968 | 9/1973 | Amberg et al. | 428/35 |
| 3,802,942 | 4/1974 | Amberg et al. | 156/443 |
| 3,823,032 | 7/1974 | Ukai | 428/35 |
| 3,823,211 | 9/1974 | Colombo | 428/315 |
| 3,859,117 | 1/1975 | Erchak et al. | 428/35 |
| 3,877,969 | 4/1975 | Tatsumi et al. | 428/35 |
| 3,889,030 | 6/1975 | Arrandale et al. | 428/35 |
| 3,979,000 | 9/1976 | Karabedian | 428/35 |

*Primary Examiner*—William R. Dixon, Jr.
*Attorney, Agent, or Firm*—Howard G. Bruss, Jr.

[57] ABSTRACT

There is disclosed herein improved packages, and methods of forming same, of the type wherein a container, such as for example a glass container, like a bottle or jar, is provided externally thereof with a heat-shrunk, cellular thermoplastic member, circumferentially and snugly engaging a sidewall portion of the container; the improvement resides in employing, as the thermoplastic member, a composite structure, or laminate, of a closed cellular polymeric layer preponderantly of polystyrene having incorporated therein from zero weight percent up to compatible amounts of a copolymer of ethylene and an alkyl ester of alpha-beta monoethylenically unsaturated carboxylic acid or a copolymer of ethylene and vinyl acetate or a copolymer of ethylene and an alpha-beta monoethylenically unsaturated carboxylic acid, or mixtures thereof, and, in adhered relationship to said cellular layer, a layer of a noncellular polymeric material preponderantly of ethylene moieties having incorporated therein moieties of vinyl acetate, or an alkyl ester of alpha-beta monoethylenically unsaturated carboxylic acid, or an alpha-beta monoethylenically unsaturated carboxylic acid, or mixtures thereof.

26 Claims, 1 Drawing Figure

CONTAINER WITH IMPROVED HEAT-SHRUNK CELLULAR SLEEVE

Figure 1:
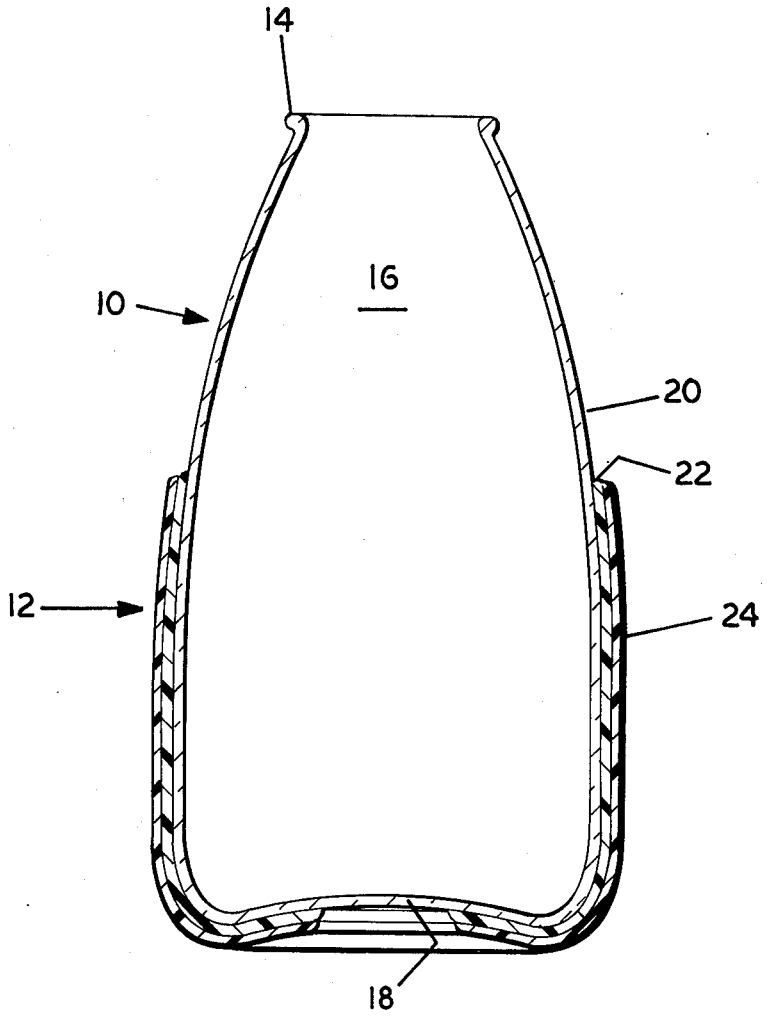

This is a continuation of application Ser. No. 505,646, filed Sept. 13, 1974, now abandoned.

The present invention relates to container packages like bottles and jars, for example, glass containers and, more particularly, relates to an improvement in packages of the type wherein a wall portion of a container is, externally and circumferentially, provided with a heat-shrunk thermoplastic cellular member. The present invention is also directed to an improved method for forming such packages.

Recently the packaging industry has successfully developed a package wherein a container, such as, for example, a bottle or jar, which has an upper rim portion defining a mouth opening thereof and a lower portion defining the bottom thereof and including an annular wall joining the rim portion to the bottom portion, is provided, at least along an axial portion of the wall with a heat-shrunk member of a foamed or cellular thermoplastic material in circumferential snug engagement therewith. This member, which is generally in the form of a sleeve, or tubular shape, provides excellent characteristics to the package and especially to a package wherein the container is a glass container. Such packages are, for example, described in U.S. Pat. No. 3,760,968. Typically these packages are produced by first forming a web, film, or sheet, of a heat-shrinkable, cellular thermoplastic material, by conventional processing, for example, by an extrusion process like a "blown bubble" extrusion process. The process is carried out to provide a heat-shrinking characteristic in the sheet, by a conventional stretching operation, in which the major heat-shrinking, or orientation, or stretching, occurs along the machine direction and only a minor heat-shrinking occurs along the transverse, or cross, direction. The sheet, or web, is also provided, by air cooling, with a skin at each opposed surface of higher density than the central, or core, portion of the cellular web and the depth of the skin on one side is at least about 1.2 times greater than the depth on the other side; these surfaces are smooth, i.e. not roughed up to become fibrillated. This sheet, or film, can then be appropriately provided with a decorative image and the sheet then slit along the machine direction of extrusion to provide rectilinear films, or sheets, which are then employed in forming the package. These rectilinear sheets, or films, are again cut, this time along the cross direction, and then formed into a generally, right cylindrical sleeve with the machine direction of prior forming being the circumferential, or radial, direction of the sleeve and the axial dimension of the sleeve being the previous cross, or transverse, dimension. The reason for this is to provide a more significant circumferential, or radial, shrinkage about the container than an axial shrinkage. Additionally, the sleeve is formed so that the greater skin depth side is the interior surface. Typically, the rectilinear sheet is formed into a sleeve by being brought into contact with a mandrel and the opposed ends of the rectilinear sheet then sealed to each other, such as, for example, in an overlapping relationship by the use of appropriate means, for example, a compressing heat mechanism. The sleeve is then brought into telescopic relation with the container and positioned or located around a wall portion and heat-shrunk to bring it into an annular snug, compressing, engagement with the wall portion of a container. After heat-shrinking, therefore, the sleeve is disposed circumferentially outwardly of the annular sidewall of the container and is in a heat-shrunk condition generally disposed at least along a portion of the axial dimension of the sidewalls. Typically, when containers are employed that have a recessed bottom, such as, a concave bottom, the heat-shrunk sleeve includes a lower annular portion extending partially inwardly into the recessed area of the bottom. For further details as to the method of forming such plastic covered containers reference may be had to U.S. Pat. No. 3,767,496 and reference may also be had to U.S. Pat. No. 3,802,942 which discloses suitable apparatus for forming such packages. The three above noted patents are hereby incorporated by reference.

Of course, the container, in addition to having the heat-shrunk member positioned therearound, may be provided with thermoplastic coating materials at various and numerous locations on the container. This concept of employing the heat-shrunk member in combination with various types, and locations, of polymeric coatings is described in co-pending application, U.S. Ser. No. 372,156, filed June 21, 1973.

In the above patents the materials which are taught to be employed to form the rectilinear sheet, or film, which is then formed into the sleeve and heat-shrunk, include polyvinyl chloride, medium or low density polyethylene, polystyrene, "copolymers of carboxylic acid monomers with ethylene (sold under the tradename SURLYN)", cellulose esters, for example, cellulose propionate, butyrate, and acetate, polyamides, and polyurethanes. From a commercial point of view the material which has been found to be most suitable to date has been a closed cellular, general purpose polystyrene material. This material has desirable characteristics, unfortunately however, this cellular polystyrene material is also possessed of certain deficiencies not the least of which include brittleness, relatively easy fracture, poor glass retention when a glass container breaks, and susceptibility to denting, scarring, and tearing, or splitting. When one considers the total process which includes slitting, or cutting, of the material this latter problem is indeed quite significant. These deficiencies of course are reflected in consumer acceptance and also in economies for providing the above packages. The other materials are also possessed of deficiencies.

Attempts to resolve some of the deficiencies of the polystyrene sleeve were made in which a polyethylene layer was provided so that it would be disposed externally of the polystyrene upon application to the container. This approach, likewise, was not entirely satisfactory inasmuch as, for example, poor adhesion of the polyethylene layer to the polystyrene resulted.

Thus, it will be seen that a problem exists in the above referred to art of providing a sleeve member which has excellent properties including ease of printability, good flexibility, a lack of undesirable brittleness, good resistance to fracture, good glass retention, and good resistance to denting, scarring, tearing, and splitting. In accordance with this invention, an improvement is provided with respect to the sleeve member and the problem in the prior art is solved. That is, the present invention satisfies a need in the art for providing a sleeve member which has the needed balance of properties.

Thus, in accordance with one feature of this invention there is provided an improvement in articles of manufacture comprised of a container having an annular rim defining a mouth opening at one end thereof, a lower end providing the bottom thereof, and an annular wall interposed between the rim and the lower end and which further includes a heat-shrunk, polymeric sleeve disposed circumferentially outwardly of said wall and in snug engagement therewith.

In accordance with another feature of this invention, there is provided an improvement in methods for producing articles of manufacture wherein a heat-shrinkable polymeric sheet is formed into a sleeve having a major orientation, or heat-shrink characteristic, circumferentially of the sleeve, and wherein the sleeve is telescopically located about the sidewall of the container and heat-shrunk into snug engagement with the sidewall.

The improvement in the above-noted method and article essentially resides in employing a heat-shrinkable polymeric sheet, and sleeve, which is of a composite structure having a layer of a closed cellular polymeric material preponderantly of polystyrene having incorporated therein, in an amount from zero weight percent up to compatible amounts, a copolymer of ethylene and vinyl acetate, or a copolymer of ethylene and an alkyl ester of an alpha-beta monoethylenically unsaturated carboxylic acid, or a copolymer of ethylene and an alpha-beta monoethylenically unsaturated carboxylic acid, or mixtures thereof, and a non-cellular polymeric layer having preponderantly ethylene moieties and incorporated therein moieties of vinyl acetate or an alkyl ester of an alpha-beta monoethylenically unsaturated carboxylic acid, or an alpha-beta monoethylenically unsaturated carboxylic acid, or mixtures thereof, the amount of said incorporated moieties in said non-cellular layer being sufficient to promote the adhesion of said layers, said cellular layer being intended for engagement with the container wall and the non-cellular layer being in adhering engagement with the cellular layer and having a smooth, glossy, non-fibrillated externally disposed outer surface.

An improved package of this invention is exemplified in FIG. 1 which is a vertical sectional elevational view. The package is comprised of a container 10 and a heat-shrunk sleeve of composite structure, generally designated 12. Container 10 includes an upper rim 14 defining a mouth opening 16 of the container and further includes a lower end, or bottom, 18 and an annular sidewall 20 interposed rim 14 and lower end 18. The container, of course, can be of any configuration and of any material, but as set forth in the drawings it is exemplified as a glass container. The ultimate package, of course, will include closure means (not shown) closing mouth opening 16. Composite polymeric sleeve 12 is disposed circumferentially outwardly of wall 20 in heat-shrunk, snug engagement therewith. Composite sleeve 12, as indicated, is a two-layer structure, the first layer 22 being a closed cellular structured polymeric material in contact with wall 20 and the second layer 24, which is of a nonfoamed or non-cellular polymeric material, is disposed outwardly of cellular layer 22 and in adhering engagement therewith. FIG. 1 also exemplifies a package in which the lower end 18 of container 10 is recessed, i.e. possessed of a lower concave bottom, with sleeve 12 including a lower annular portion extending partially inwardly into the recessed area of the bottom.

The composite structure for use herein has a closed cellular polymeric layer 22 and a non-cellular polymeric layer 24 adhered to the cellular layer. The polymeric material itself, of the cellular layer, is preponderantly polystyrene which has incorporated therein, from zero weight percent to compatible amounts, of a copolymer of ethylene and vinyl acetate or a copolymer of ethylene and an alkyl ester of an alpha-beta monoethylenically unsaturated carboxylic acid or a copolymer of ethylene and an alpha-beta monoethylenically unsaturated carboxylic acid, or mixtures thereof. Similarly, the polymeric portion of the non-cellular layer is preponderantly ethylene moieties having incorporated therein vinyl acetate moieties or moieties of an alpha-beta monoethylenically unsaturated carboxylic acid, or moieties of an alkyl ester of an alpha-beta monoethylenically unsaturated carboxylic acid, or mixtures thereof. The adherence of polystyrene to polyethylene is quite poor; accordingly, the above copolymers when incorporated into the cellular polystyrene and/or the moiety of the non-cellular layer provide for the adhesion of the respective layers and provide the composite structure with other beneficial characteristics. While ethylene homopolymers, for example polyethylene, are generally not compatible with polystyrene, the above referred to copolymers have limited compatibility with polystyrene. Thus, these copolymers are incorporated in the polystyrene in an amount of anywhere from zero weight percent up to the compatible amount thereof in polystyrene. Those skilled in the art will routinely determine this compatible amount which, as used herein, means the amount which is generally miscible with polystyrene so as to be able to form a homogeneous polymeric material when combined and melt extruded. Thus, in one embodiment it will be seen that the non-cellular layer has moieties of ethylene and, vinyl acetate or an alkyl ester of an alpha-beta monoethylenically unsaturated carboxylic acid or an alpha-beta monoethylenically unsaturated carboxylic acid or mixtures thereof, and that the cellular layer, in addition to the polystyrene, contain these same types of moieties thereby providing for the adhesion of the two layers. In passing, it is generally preferred that exactly the same chemical moieties, of course, with the exception of polystyrene per se, when present in the cellular layer also be present in the non-cellular layer, but this will not be found to be essential. The amounts of copolymer incorporated in the polystyrene, along with the moiety (i.e., the vinyl acetate or an alkyl ester of an alpha-beta monoethylenically unsaturated carboxylic acid or an alpha-beta monoethylenically unsaturated carboxylic acid, or mixtures thereof) of the preponderantly ethylene non-cellular polymeric layer, as balanced so as to be present in effective adhesion promoting amounts. As a general matter, the less of the copolymer which is incorporated in the preponderantly polystyrene layer the more concentrated will need to be the moiety, of vinyl acetate or an alkyl ester of an alpha beta monoethylenically unsaturated carboxylic acid (hereinafter alkyl ester) or an alpha-beta monoethylenically unsaturated carboxylic acid, hereinafter acid, or mixtures thereof, in the non-cellular preponderantly ethylene layer to provide for this adhesion. In fact, in another embodiment the cellular layer will be virtually all polystyrene, with no incorporated copolymer, and the non-cellular layer will be a moiety sufficient to provide for the adhesion of the layers. In passing, it should be mentioned however that the polymeric material of the non-cellular layer will be preponderantly ethylene moieties and that the polymeric portion of the cellular layer will be preponderantly polystyrene, i.e. each of those layers will generally be at least about 60 weight percent, and desirably on the order of at least about 80 weight percent of ethylene and polystyrene, respectively. The amounts of the respective materials, that is of the copolymer incorporated into the preponderantly polystyrene cellular layer and the amounts of the respective moieties incorporated with ethylene in the non-cellular layer, will of course vary with different materials and with different applications. Generally, however, it may be stated that these amounts can be simply and routinely determined by a quick adhesion test wherein the respective layers of the composite structure are pulled apart, or peeled away, by hand with acceptable adhesion being determined by the occurrence of areas on the non-cellular layer where material of the cellular layer is still adhered; that is, in peeling the layers apart a portion of the cellular layer ruptures and remains attached to the non-cellular layer for acceptable adhesion, as opposed to the layers splitting without any attachment of a portion of the cellular layer onto the non-cellular layer. Thus, for example, if the cellular layer consists virtually of 100 percent styrene homopolymer and the non-cellular layer consists virtually of 100 percent of an ethylene homopolymer, it will be found that poor adhesion results in this peeling apart in that the films are easily separated with no retention of the cellular layer onto the non-cellular layer. The desired copolymers which are incorporated into the polystyrene to form the cellular layer can be incorporated by any conventional techniques, for example, blending of the materials in a ribbon blender prior to the formation of the composite structure. Similarly the desired moiety of the non-cellular layer can simply be provided by incorporating, for example by admixing or blending, polyethylene with a copolymer of ethylene and vinyl acetate, or a copolymer of ethylene and an alkyl ester of a monoethylenically unsaturated carboxylic acid, or a copolymer of ethylene and an alpha-beta monoethylenically unsaturated acid, or mixtures thereof, or the non-cellular polymeric layer may itself simply be a copolymer; that is in the former instance the ethylene moieties of the non-cellular polymeric layer are provided by a combination of ethylene moieties from polyethylene and ethylene moieties from a copolymer or, in the latter instance, the ethylene moieties can be simply provided by all being present in a copolymer. The amount of the incorporated moieties of vinyl acetate, or an alkyl ester of an alpha-beta monoethylenically unsaturated carboxylic acid, or an alpha-beta monoethylenically unsaturated carboxylic acid, or mixtures thereof, in the preponderantly ethylene non-cellular layer will, as indicated above, be an amount sufficient to promote the adhesion of the layers. This amount will vary depending on the particular composition employed and the particular application involved and, of course, will generally be at a maximum when the amount of copolymer incorporated in the preponderantly polystyrene layer is at a minimum, for example, at about zero percent. The main practical considerations in selecting the maximum amount of the adhesion promoting moiety of the non-cellular layer will be that the composition be capable of forming a sheet or film, preferably be extrudable and the cellular layer remain flexible, resilient, and be possessed of a smooth, glossy, generally nonfibrillated surface and one which is nontacky.

The materials employed are widely commercially available and those skilled in the art will routinely select the appropriate materials. With regard to polystyrene, it is generally preferred to employ that polystyrene which is referred to in the art as general purpose styrene. Exemplary of these polystyrenes are those available from Dow Chemical Company under their designation 6041 as well as those available from Koppers Chemical Company under their designation 8G. Exemplary of the commercially available polystyrenes which will be found to be suitable are those having weight average molecular weights in excess of about 100,000, for example in the range of about 240,000 to 320,000, or those having melt flows in the range of about 1 to about 5 (ASTM Test D12378-70 at ASTM Condition G). A particularly suitable polystyrene has a weight average molecular weight of about 280,000 and a melt flow of about 2.0. Exemplary of suitable copolymers of ethylene and vinyl acetate are those copolymers having a vinyl acetate content, or moiety, of less than about 40 weight percent and an ethylene content, or moiety, in excess of about 60 weight percent. Exemplary of these copolymers are the copolymers of ethylene and vinyl acetate commercially supplied by U.S.I. having vinyl acetate moieties ranging from about 18 to about 33 weight percent, ethylene moieties in an amount of about 67 to about 82 weight percent and melt indexes ranging from about 0.4 to about 125. Preferred compositions are those having vinyl acetate moieties in the range of about 28 to 31 weight percent with melt indexes in the range of about 1 to about 3. Exemplary copolymers of ethylene and an alkyl ester of an alpha-beta monoethylenically unsaturated carboxylic acid are those wherein the carboxylic acid moiety contains from 3 to 5 carbon atoms and wherein the alkyl moiety contains from 1 to 3 carbon atoms; for example, methyl, ethyl, and propyl esters of, for example, acrylic acid, methacrylic acid, and ethacrylic acid. Preferably these copolymers will have an ethylene content, or moiety, in excess of about 75 weight percent and the moiety of the alkyl ester of a monoethylenically unsaturated carboxylic acid will be less than about 25 weight percent and desirably these copolymers will have melt indexes of less than about 21 and preferably in the range of about 1 to 3. A particularly preferred copolymer is a copolymer of ethylene and ethylacrylate such as, for example, those commercially supplied by Union Carbide Corporation having ethylacrylate moieties in the range of about 1.7 to about 22.5 weight percent and ethylene moieties in the range of about 98.3 percent to about 77.5 weight percent, with melt indexes in the range of about 0.1 to 21. Particularly suitable ethylene copolymers are those having an ethylacrylate moiety of about 11 weight percent to about 22 percent and an ethylene content of about 89 to about 78 weight percent, with those having an ethylacrylate moiety of about 15 to about 18 weight percent and an ethylene moiety of about 82 to about 85 weight percent being especially suitable and which have melt indexes in the range of about 1 to about 3. Exemplary of the copolymers of ethylene and an alpha-beta monoethylenically unsaturated carboxylic acid are the commercially available copolymers wherein the carboxylic acid moiety contains from 3 to 5 carbon atoms including, for example, acrylic acid, methacrylic acid, and ethacrylic acid. Further exemplary of these copolymers are those having an ethylene moiety in excess of about 65 percent preferably in excess of about 80 percent and wherein the moiety of the alpha-beta monoethylenically unsaturated carboxylic acid is less than about 35 weight percent and preferably less than about 20 weight percent. Preferably these copolymers will have melt indexes in the range of about 1 to about 5.

As hereinbefore indicated, the non-cellular layer which will be predominantly of ethylene moieties and will contain moieties of vinyl acetate or an alkyl ester of an alpha-beta monoethylenically unsaturated carboxylic acid, or an alpha-beta monoethylenically unsaturated carboxylic acid, or mixtures thereof, can be prepared by simply blending, or admixing, with polyethylene a copolymer of ethylene and, vinyl acetate or an alkyl ester of an alpha-beta monoethylenically unsaturated carboxylic acid or an alpha-beta monoethylenically unsaturated carboxylic acid. The polyethylene which may be employed is well known in the art and will be routinely selected by those skilled in the art. Particularly suitable polyethylene is low density polyethylene, that is polyethylene having a density of about 0.925 or less, and generally in the range of about 0.910 to about 0.925 grams per cubic centimeter. Of course, if desired, the desired non-cellular layer moiety may be provided by simply using a copolymer of the desired moiety instead of producing this equivalent moiety by the blending of polyethylene with a copolymer.

In one of the best modes contemplated in practicing this invention, the polymeric cellular layer will be between about 90 to about 95 weight percent polystyrene and between about 5 to about 10 weight percent of a copolymer of about 28 weight percent vinyl acetate and about 72 weight percent of ethylene (hence producing a polymeric cellular layer with a styrene moiety of about 90 to about 95 weight percent, a vinyl acetate moiety of about 1.4 to about 2.8 percent, and an ethylene moiety of about 3.6 to about 7.2 weight percent). Preferably the cellular layer will be between about 7 or 8 percent of that copolymer and about 92 or 93 percent polystyrene. The polymeric non-cellular layer of this mode will be between about 60 weight percent to about 90 weight percent of polyethylene having incorporated therein about 10 weight percent to about 40 weight percent of a copolymer of about 28 percent vinyl acetate and about 72 weight percent of the ethylene (hence producing a non-cellular layer wherein the ethylene moiety is between about 88.8 weight percent to about 97.2 weight percent and the vinyl acetate moiety being about 2.8 weight percent to about 11.2 percent). Preferably the vinyl acetate will be incorporated into the non-cellular layer by admixing about 80 weight percent of polyethylene with about 20 weight percent of that copolymer. Of course, as indicated above, if desired there is no need to employ the admixture for the non-cellular layer but these moieties may be obtained by using a copolymer per se in which the ethylene and vinyl acetate moieties are as indicated. In the other preferred mode of practicing this invention, the polymeric cellular layer will consist essentially of polystyrene and the non-cellular layer will be a copolymer of about 85 weight percent ethylene and about 15 weight percent of the ethyl acrylate.

The amounts of the respective materials will be routinely adjusted, given the foregoing guidelines, but, in general, it may be stated that excellent results will be generally obtained wherein the polymeric portion of the cellular layer is in excess of about 85 weight percent of styrene moieties and from about zero to about 4 or 5 weight percent of vinyl acetate, or an alkyl ester of an alpha-beta monoethylenically unsaturated carboxylic acid, or an alpha-beta monoethylenically unsaturated carboxylic acid moieties, or mixtures thereof, with the amount of ethylene varying depending on the composition of the copolymer employed. Of course the amount of the copolymer will not be an amount which is in excess of that which is miscible with the polystyrene, i.e. it will be up to a compatible amount. The composition of the polymeric portion of the non-cellular layer can of course vary as indicated, but it will preponderantly have ethylene moieties and the other moieties varied so long as a smooth, glossy, non-tacky, surface is produced. Suitable moieties will include from 2 or 3, e.g. about 2.8, weight percent of vinyl acetate, or an alkyl ester of an alpha-beta monoethylenically unsaturated carboxylic acid, or alpha-beta monoethylenically unsaturated carboxylic acid, or mixtures thereof, for example up to about 40 weight percent with the ethylene moieties being between about 60 weight percent and about 97.2 percent, but preferably the ethylene moiety will be in the range of about 98 percent to about 72 or 75 weight percent with the moieties of the vinyl acetate, alkyl ester, acid, or mixtures, as enumerated above, being between about 2 or 3 percent to about 25 or 28 weight percent.

The characteristics of the composite structure contemplated for use herein will, of course, vary with different applications. Generally, however, when the composite structure is used as a heat-shrunk sleeve about a glass container quite excellent results will be obtained by using a composite structure having a total thickness of about 8 to about 22 mils with the thickness of the non-cellular layer being about 1 to about 10 mils, preferably about 2 to about 5 mils. The density of the cellular layer will be in the range of about 4 to about 25, for example about 11 to about 18 pounds per cubic foot. Suitably the cellular layer will have a density of about 15 pounds per cubic foot and a cell count at the surfaces on the order of about 10,000 to about 22,000 cells per square inch. The composite structure used herein will have a heat-shrinkage characteristic in which the shrinkage in the machine direction (or considering the sleeve, the circumferential direction) will be of major amount relative to the shrinkage in the cross, or transverse, direction (or considering the sleeve, the axial direction). Exemplary of these ratios are a heat-shrinkage in the machine direction relative to the heat-shrinkage in the cross direction of at least about 2.5:1 and, preferably, at least about 3:1, with representative heat-shrinkages, in the temperature range of about 200° F to about 300° F, being about 35 to 85% in the machine direction and about 3 to about 32% in the cross direction.

The heat-shrinkable composite structure can be fabricated into sheets using technology which is well known to those skilled in the art. These sheets are then employed in the manner of the hereinbefore incorporated patents. The closed cellular layer which is heat-shrinkable can be produced using conventional technology for forming cellular heat-shrinkable polystyrene and, likewise, the non-cellular layer is produced using conventional technology for forming non-cellular polyethylene sheets or film. These two layers are joined together to form the composite structure, likewise employing conventional technology. In the preferred practice of forming the composite structure, extrusion coating is employed wherein the non-cellular layer of a polymeric material predominantly of ethylene moieties and the above described incorporated other moieties, e.g. vinyl acetate, is extrusion coated onto a previously formed heat-shrinkable, closed cellular film, or sheet, of a polymeric material preponderantly of polystyrene and optionally including the above described copolymers, or mixtures thereof. It is not necessary to stretch the non-cellular layer to provide it with an independent heat-shrinkable characteristic and all that is required is to extrusion coat the non-cellular polymeric material onto the heat-shrinkable, cellular polymeric material layer.

One technique for forming the heat-shrinkable cellular layer is indicated in incorporated U.S. Pat. No. 3,767,496. Other conventional techniques will be immediately apparent to those skilled in the art. The preferred technique for forming the closed cellular heat-shrinkable composite for use herein and, more specifically, the heat-shrinkable, cellular layer involves a conventional process referred to as a "blown bubble" technique in which tandem extruders are employed, one of which is a vented extruder and the other of which carries an annular, generally circular, extrusion die with a complementing mandrel, through which and over which, respectively, the blown bubble, or tube, is extruded and drawn. The tube is cut, or slit, on diametrically opposed sides and rolled onto winding wheels. The winding wheels place the extruded material under tension to produce the desired stretching, and resultant orientation, and heat-shrinkage characteristics in the cellular layer. Additionally conventional air cooling is employed to produce the desired skin layer on the respective sides of the material issuing from the die. In this technique the appropriate polymeric materials, i.e. the polystyrene and, optionally, copolymer(s), along with the requisite blowing agent, or agents, and/or nucleators, as well as suitable adjuvants, which may include pigments, stabilizers, and the like, are charged into the first extruder, the material appropriately mixed in the extruder and heated and then extruded from the second extruder and formed into the heat-shrinkable cellular layer and wound into a sheet or film of rolled stock. Generally, the polystyrene and copolymer, or mixtures, will be appropriately admixed, for example in a ribbon blender, prior to charging into the hopper for feeding into the extruder. Any of the conventional blowing agents may be employed, either with or without suitable nucleators in effective foaming or cell forming amounts. Thus, chemical blowing agents can be employed such as the conventionally well known azo compounds, N-nitroso compounds, or the sulfonyl hydrazides. Preferably, however, the blowing agent will be a physical blowing agent and most desirably will also be used in conjunction with a nucleating agent. Representative of the physical blowing agents are the alkanes, such as for example pentane, hexane, and heptane, and halogenated materials such as methyl chloride, methylene chloride, trichloroethylene, dichloroethane, dichlorotetrafluoroethane, trichlorofluoromethane, trichlorotrifluoroethane, dichlorodifluoromethane and the like. An especially suitable material is pentane, used in conjunction with a nucleating agent, e.g. a mixture of sodium bicarbonate and citric acid. The resulting sheet or film of rolled stock which is produced may then be appropriately decorated and used directly as a feed stock for forming the composite structure. Conventional decorating techniques may be employed with flexographic decoration, or printing, of the side of the sheet which was originally the inside surface of the blown bubble, and which has the smaller skin layer, using solvent based flexographic inks being preferred.

Conventional techniques such as those disclosed in *Encyclopedia of Polymer Science and Technology,* 1965, Volume 3, pg. 777 and POLYETHYLENE, Reinhold, *Plastics Application Series,* Vol. 1, page 87, for extrusion coating a substrate with polyethylene is employed to finally fabricate the composite structure contemplated for use herein. The extrusion coating extruder is a conventional screw extruder and is charged with the selected polymeric moieties, either in the form of a copolymer or as a blend or admixture as previously described and is provided with a slit die which is disposed in close proximity to two rolls, one of which is a smooth cooled, or chilled, roll, and the other of which is a smooth rubber covered pressure roll. Of course conventional adjuvants may also be included in the charge of polymeric material supplied to the extruder. The sheet or film of the heat-shrinkable, cellular rolled stock, which is usual practice will have a decorated surface portion, is supplied to the nip of these two rolls and the discharge from the slit die of the extrusion coating extruder is supplied to the nip of the two rollers whereby the two materials are brought into contact and adhering relationship with each other with the non-cellular layer being, preferably, applied to the surface of the cellular layer which has been decorated.

Of course, it is not necessary to decorate the cellular layer prior to its being extrusion coated with the non-cellular layer but, by doing so, the composite structure becomes possessed of an additional, highly important, characteristic. That is, the decoration thus becomes disposed between the two layers and is visible through and protected by the non-cellular layer, hence providing a more permanent and resistant decoration. For example, this arrangement provides excellent resistance of the decoration to caustic and other chemical attack. This material represents the heat-shrinkable composite structure, contemplated for use herein, is then wound onto rolls to provide the heat-shrinkable composite structure which may be employed in accordance with the teachings of U.S. Pat. Nos. 3,767,496, 3,802,942, and 3,760,968. That is, the sheet or film stock of the composite structure is appropriately slit to provide a rectilinear sheet, or film, which is then formed into a sleeve, or tubular member, by bringing the longitudinal extremities of the sheet into contact with each other and appropriately sealing these sheet extremities, preferably in an overlapped relationship, by contact with appropriate means such as, for example, by heat sealing these extremities with a heated bar or wire. The sleeve is so formed such that the major heat-shrinkage, which previously was in the machine direction of extrusion, is now in the circumferential, or radial, direction of the sleeve and the previous minor shrinkage direction, which as the cross or transverse direction, is now the axial direction of the sleeve. This sleeve member is then telescopically located about the sidewall 20 of container 10 with the closed cellular layer being adjacent the wall surface of the container and the non-cellular being disposed outwardly of the cellular layer. Subsequently, conventional heating techniques are employed, e.g. heating in an oven, for a time and at a temperature sufficient to allow the heat-shrinkable sleeve member to shrink, and contract, into snug engagement with the container wall surface.

While the foregoing describes the present invention with sufficient particularity to enable those skilled in the art to make and use same, there, nonetheless, follows a general example.

The composite heat-shrinkable structure contemplated for use herein was made in accordance with the following procedure. The closed cellular layer was produced employing a vented 4½ inch extruder having a length to diameter (L/D) ratio of 24:1 in tandem operation with a 6 inch screw extruder having a L/D ratio of 24:1. General purpose polystyrene, having a weight average molecular weight of about 280,000 and a melt flow of about 2.0, was first combined in a ribbon blender with a copolymer of ethylene and vinyl acetate, the copolymer being about 28 percent by weight vinyl acetate and 72 percent by weight ethylene with a melt index of about 3.0, to form a polymeric material which was 93 weight percent polystyrene and 7 weight percent of the copolymer. The 4½ inch extruder was then fed with a charge of about 99.25 percent of the above polymeric material, about 0.34 percent by weight of sodium bicarbonate, about 0.26 percent by weight citric acid, and about 0.15 percent by weight of white mineral oil. The 4½ inch extruder was generally operated between a temperature of about 240° F. to about 425° F. and pentane (6 percent by weight of the above charge) was injected through the vent in the barrel into the 4½ inch screw extruder. The output of this extruder was then fed, at a temperature of about 425° F. into the 6 inch extruder and the latter was provided with appropriate cooling to maintain the zone temperatures in the 6 inch screw extruder in a range of about 250° to 290° F. The extrudate issued as a tubular member from the circular die of the 6 inch extruder with the die being maintained at a temperature of about 307° F. By means of tension rollers the tubular member was pulled over a sizing mandrel, which was maintained at a temperature of about 120° F., and the film then subsequently slit by diametrically opposed knives. As the extrudate issued from the die the external surface was contacted with air having a pressure on the order of about 7–8 ounces per square inch and the inside surface was contacted with air having a pressure on the order of about 14 ounces per square inch to provide a different depth skin layer on each side. The diameter of the mandrel employed was about 22.4 inches and the diameter of the tubular die being about 12.75 inches resulting in a blow up ratio of about 1.76. Additionally, the tension on the rollers was such that the resulting closed cellular layer had a machine direction heat-shrinkage of about 65 to 85 percent at 300° F. and a cross direction heat shrinkage of about 20 to 30 percent at 300° F. The density of the resulting heat-shrinkable cellular layer was about 13 pounds per cubic foot and had a thickness of about 15 mils. This heat-shrinkable closed cellular layer was then wound on a winding roll with the edges of the sheet being trimmed with cutting knives to provide a sheet of relatively uniform width. Additionally, the sheet was provided with a decorative image on one side employing flexographic decorating techniques. The throughput in the above described process for forming the cellular heat-shrinkable layer was about 530 pounds per hour.

The non-cellular layer was produced by charging a 2½ inch screw extruder having a L/D ratio of 20:1 with a charge of 80 percent by weight of polyethylene having a melt index of 3.0 and a density of about 0.921 grams/cc and about 20 percent by weight of an ethylene-vinyl acetate copolymer which contained about 28 percent by weight vinyl acetate, about 72 percent by weight ethylene and had a melt index of about 3.0. The extruder was run at a throughput of about 95 pounds per hour with the barrel temperatures ranging from about 320° F. to about 420° F. and the die having a temperature of about 430° F. A film on the order of about 3 mils was dispensed from the slit die to the nip of two juxtaposed rolls (one being a water cooled roll, and the other being a smooth rubber coated roll) and the rolled stock of the cellular layer was likewise fed into the nip wherein the films were compressed together in excellent adhering relationship with the opposite surfaces being quite smooth. The non-cellular layer was contacted to the side of cellular layer having the thinner skin (decorated side). The output from this extrusion coating technique was then slit along the machine direction to form rectilinear strips, or sheets, of the composite structure and wound onto a roll for stock.

The rectilinear strips of this composite structure were then again slit (along the cross direction) and wound around a generally cylindrically shaped mandrel with the longitudinal extremities of the resulting sheet being brought into overlapping contact with each other and then heat sealed in overlapped relationship by contact with an electrically heated bar. The formation of this sleeve was done in such fasion that the cellular layer is disposed inwardly of the sleeve, the non-cellular layer outwardly, and the major direction of shrinkage being in the circumferential, or radial, direction. In general, the processing of the composite material, e.g. the formation of the sleeve and the formation of the package was done following the disclosures of U.S. Pat. Nos. 3,767,496 and 3,802,942. The sleeve member, with its smooth or nonfibrillated surfaces, was then, from beneath a glass container of the type illustrated in the drawing, telescopically located about the sidewall of the container with a portion, i.e. about the lower half inch of the sleeve being disposed beneath the lowest extremity of the container. The container had been preheated to a temperature of about 240° F. and with the telescopic location of the sleeve about the container an initial heat-shrinking took place which held it in place on the bottle. Generally, the inside diameter of the sleeve was sized to be just slightly larger, i.e. on the order of about 0.31 inch larger than the diameter of the container. The container with the sleeve on it was then put in a heating tunnel maintained at about 400° for about 5 or 6 seconds whereby final shrinking resulted in which the sleeve was brought into snug engagement with the wall surface and the lower portion of the sleeve shrunk so as to extend inwardly into the recessed bottom of the container. The composite structure possessed excellent stability, i.e. the adhesion of the two layers was excellent. Additionally, it was observed that prior difficulties with splitting and tearing were significantly alleviated and the resulting container was quite aesthetically pleasing. This sleeve, likewise, possessed all the desired balance of properties required for such application. This same procedure when repeated wherein the cellular layer consists essentially of polystyrene (no copolymer added) and the non-cellular layer consists essentially of a copolymer of about 85 weight percent ethylene and about 15 weight percent ethyl acrylate, shows substantially identical excellent results.

While the foregoing describes the present invention with sufficient particularity to enable those skilled in the art to make and use same, it will be apparent that modification is possible which does not depart from the spirit thereof. In the claims which follow it will be apparent that reference to the composition of the respective layers is to the polymeric material thereof and does not exclude the presence of conventional adjuvants in either, or both, of layers such as, for example, pigments, stabilizers, plasticizers, and the like; usually however there will be no need for such adjuvants.

I claim:

1. In an article of manufacture comprising a container having a sidewall and further including a polymeric sleeve disposed circumferentially outwardly of said sidewall and in snug heat shrunk engagement therewith, the improvement wherein said polymeric sleeve is a composite structure of a closed cellular polymeric layer preponderantly of polystyrene having incorporated therein, in an amount from zero weight percent up to compatible amounts, a copolymer of ethylene and vinyl acetate, or a copolymer of ethylene and an alkyl ester of an alpha-beta monethylenically unsaturated carboxylic acid, or a copolymer of ethylene and an alpha-beta monoethylenically unsaturated carboxylic acid, or mixtures thereof, and a noncellular polymeric layer having preponderantly ethylene moieties and incorporated therein moieties of vinyl acetate or an alkyl ester of an alpha-beta monoethylenically unsaturated carboxylic acid, or an alpha-beta monoethylenically unsaturated carboxylic acid, or a mixtures thereof, the amount of said incorporated moieties in said non-cellular layer being sufficient to promote the adhesion of said layers, said non-cellular layer being disposed outwardly of said cellular layer and in adhering engagement therewith.

2. The improvement of claim 1 wherein said cellular polymeric layer consists essentially of polystyrene and a copolymer of ethylene and vinyl acetate and said non-cellular polymeric layer consists essentially of ethylene moieties and vinyl acetate moieties.

3. The improvement of claim 2 wherein said copolymer is a copolymer of about 28 weight percent vinyl acetate and about 72 weight percent ethylene, said copolymer being present in said cellular layer in an amount of about 5 to about 10 weight percent and said polystyrene having present in an amount of about 90 to about 95 weight percent.

4. The improvement of claim 3 wherein said noncellular polymeric layer consists essentially of about 60 to about 90 weight percent polyethylene admixed with about 10 to about 40 weight percent of a copolymer of about 28 weight percent vinyl acetate and about 72 weight percent ethylene.

5. The improvement of claim 1 wherein said cellular polymeric layer consists essentially of polystyrene and said non-cellular layer consists essentially of a copolymer of ethylene and ethyl acrylate.

6. The improvement of claim 5 wherein said copolymer is a copolymer of about 11 to about 22 weight percent ethyl acrylate and about 89 to about 78 weight percent ethylene.

7. The improvement of claim 1 wherein said cellular layer consists essentially of polystyrene and a copolymer of ethylene and an alpha-beta monoethylenically unsaturated carboxylic acid.

8. The improvement of claim 7 wherein said cellular layer consists essentially of at least about 60% by weight of polystyrene and a copolymer of ethylene and an alpha-beta monoethylenically unsaturated carboxylic acid wherein the ethylene moiety of said copolymer is in excess of about 65%.

9. The improvement of claim 8 wherein said polystyrene is present in at least about 80% by weight and said ethylene moiety of said ethylene and unsaturated carboxylic acid copolymer of said cellular layer is in excess of about 80%.

10. The improvement of claim 1 wherein said composite structure includes a decoration disposed between said cellular layer and said non-cellular layer.

11. The improvement of claim 1 wherein said cellular layer consists essentially of at least about 60% by weight of polystyrene and a copolymer of ethylene and vinyl acetate and wherein the ethylene moiety of said ethylene and vinyl acetate copolymer in said cellular layer is in excess of about 60%.

12. The improvement of claim 11 wherein said polystyrene is present in an amount of at least about 80% by weight and wherein the vinyl acetate moiety of said cellular layer is between about 18 to about 33%.

13. The improvement of claim 1 wherein said cellular layer consists essentially of at least about 60% by weight polystyrene and a copolymer of ethylene and an alkyl ester of an alpha-beta monoethylenically unsaturated carboxylic acid and wherein the ethylene moiety of said ethylene and alkyl ester copolymer in said cellular layer is in excess of about 75%.

14. The improvement of claim 13 wherein said polystyrene of said cellular layer is present in at least about 80% by weight and said ethylene and alkyl ester copolymer of said cellular layer is a copolymer of ethylene and ethyl acrylate.

15. The improvement of claim 1 wherein the ethylene moiety of said non-cellular layer is at least about 80% by weight.

16. The improvement of claim 15 wherein said non-cellular layer consists essentially of (1) an admixture of polyethylene and a copolymer of ethylene and vinyl acetate or (2) a copolymer of ethylene and vinyl acetate and wherein the ethylene moiety of said non-cellular layer is between about 88.8% to about 97.2% and the vinyl acetate moiety of said non-cellular layer is between about 2.8 to about 11.2%.

17. The improvement of claim 1 wherein said noncellular layer consists essentially of (1) a copolymer of ethylene and vinyl acetate or (2) a copolymer of ethylene and an alpha-beta monoethylenically unsaturated carboxylic acid or (3) a copolymer of ethylene and an alkyl ester of an alpha-beta monoethylenically unsaturated acid or (4) mixtures thereof or (5) an admixture of polyethylene with one of said copolymers or mixtures thereof and wherein the ethylene moiety of said noncellular layer is between about 72 to about 98%.

18. A heat shrinkable, sleeve-shaped article of composite construction having a first layer of a heat-shrinkable, closed cellular polymeric material consisting essentially of preponderantly polystyrene and, from zero weight percent up to compatible amounts, of a member selected from the group consisting of a copolymer of ethylene and vinyl acetate, a copolymer of ethylene and an alkyl ester of an alpha-beta monoethylenically unsaturated carboxylic acid, a copolymer of ethylene and an alpha-beta monoethylenically unsaturated carboxylic acid, and mixtures thereof, and a second layer in adhered engagement to said first layer, said second layer being a non-cellular polymeric material consisting essentially of preponderantly ethylene moieties and moieties of a member selected from the group consisting of vinyl acetate, an alkyl ester of an alpha-beta monoethylenically unsaturated carboxylic acid, an alpha-beta monoethylenically unsaturated carboxylic acid, and mixtures thereof, the amount of said moieties being sufficient to promote the adhesion of said respective layers, said noncellular layer being disposed outwardly of said cellular layer and in adhering engagement therewith said sleeve having a greater heat shrinkage in the radial direction thereof than in the axial direction thereof.

19. The improvement of claim 18 wherein said cellular polymeric layer consists essentially of polystyrene and a copolymer of ethylene and vinyl acetate and said non-cellular polymeric layer consists essentially of ethylene moieties and vinyl acetate moieties.

20. The improvement of claim 19 wherein said copolymer is a copolymer of about 28 weight percent vinyl acetate and about 72 weight percent ethylene, said copolymer being present in said cellular layer in an amount of about 5 to about 10 weight percent and said polystyrene being present in an amount of about 90 to about 95 weight percent.

21. The improvement of claim 18 wherein said cellular polymeric layer consists essentially of polystyrene and said non-cellular layer consists essentially of a copolymer of ethylene and ethyl acrylate.

22. The composite article of claim 18 wherein said article has a heat shrinkage, in the temperature range of about 200° F. to about 300° F., in the radial direction of about 35 to about 85 percent and a heat shrinkage in the axial direction of about 3 to about 32 percent.

23. The article of claim 18 and further including a decoration disposed between said cellular and said non-cellular layer and wherein said cellular layer is disposed inwardly of said non-cellular layer.

24. The article of claim 18 wherein said cellular polymeric material consists essentially of at least about 80% polystyrene and wherein said non-cellular layer consists essentially of a copolymer of ethylene and an alkyl ester of an alpha-beta monoethylenically unsaturated carboxylic acid or an admixture of polyethylene and a copolymer of ethylene and an alkyl ester of an alpha-beta monoethylenically unsaturated carboxylic acid and wherein the ethylene moiety of said non-cellular layer is in excess of about 80%.

25. The article of claim 18 wherein said polymeric material of said cellular layer consists essentially of at least about 80% by weight of polystyrene and wherein said noncellular polymeric material consists essentially of a copolymer of ethylene and an alpha-beta monoethylenically unsaturated carboxylic acid or an admixture of polyethylene and a copolymer of ethylene and an alpha-beta monoethylenically unsaturated carboxylic acid and wherein the ethylene moiety of said noncellular layer is at least about 80% ethylene.

26. The article of claim 18 wherein said polystyrene is present in said cellular layer in an amount of at least about 80% and wherein said non-cellular layer consists essentially of a copolymer of ethylene and vinyl acetate or an admixture of polyethylene and a copolymer of vinyl acetate wherein the ethylene moiety of said non-cellular layer is at least about 80%.

* * * * *